United States Patent [19]

Asmanes

[11] 4,162,593

[45] Jul. 31, 1979

[54] TOOL HOLDER FOR PREPARATION AND INSPECTION OF A RADIUSED EDGE CUTTING TOOL

[75] Inventor: Charles Asmanes, Oak Ridge, Tenn.

[73] Assignee: The United States of America as represented by the United States Department of Energy, Washington, D.C.

[21] Appl. No.: 881,965

[22] Filed: Feb. 28, 1978

[51] Int. Cl.[2] ..... B24B 19/00

[52] U.S. Cl. ..... 51/218 R; 51/234; 125/11 A; 308/15

[58] Field of Search ..... 308/8, 15; 51/218 A, 51/218 R, 218 T, 234, 124 R; 125/11 A

[56] References Cited

U.S. PATENT DOCUMENTS

| | | | |
|---|---|---|---|
| 2,454,472 | 11/1948 | Monkley | 51/124 R X |
| 3,449,198 | 6/1969 | Spragg | 51/234 X |
| 4,082,377 | 4/1978 | Saunders | 308/15 |

OTHER PUBLICATIONS

IBM Technical Disclosure Bulletin, vol. 18, No. 6, dated Nov. 1975, "Molded Ball and Socket".

*Primary Examiner*—Harold D. Whitehead
*Attorney, Agent, or Firm*—Dean E. Carlson; Stephen D. Hamel; David E. Breeden

[57] ABSTRACT

A tool holding fixture is provided for removably holding a radiused edge cutting tool in a tool edge lapping apparatus. The fixture allows the operator to preset the lapping radius and angle before the tool holder is placed in the fixture and the holder may be removed from the lapping apparatus to inspect the tool and simply replaced in the fixture to continue lapping in accordance with a precise alignment without realignment of the tool relative to the lap. The tool holder includes a pair of self aligning bearings in the form of precision formed steel balls connected together by a rigid shaft. The tool is held by an arm extending from the shaft and the balls set in fixed position bearing cups and the holder is oscillated back and forth about a fixed axis of rotation to lap the tool radius by means of a reversibly driven belt-pulley arrangement coupled to the shaft between the bearings. To temporarily remove the holder, the drive belt is slipped over the rearward end of the holder and the holder is lifted out of the bearing cups.

4 Claims, 2 Drawing Figures

TOOL HOLDER FOR PREPARATION AND INSPECTION OF A RADIUSED EDGE CUTTING TOOL

BACKGROUND OF THE INVENTION

This invention was made during the course of, or under, a contract with the United States Department of Energy.

This invention relates generally to tool holding fixtures and more specifically to a tool holding fixture for removably holding a radiused edge tool at a precise preset lapping radius during repeated lapping and inspection of the tool.

The uniformity of the cutting edge of a tool has a direct relationship to the surface finish of a part machined with the tool. In high precision machining it has become increasingly important to be able to prepare and inspect the cutting edge of a tool to ensure that it is smooth and free of nicks or chips in order to ensure a high-quality surface on precision machined parts. Conventional preparation of high precision tools having a radiused cutting edge generally involves a grinding operation in which the tool is coursely finished to the desired shape, and the surfaces are lapped to provide the final precision surface finish. In both the grinding and lapping operations, the tool is conventionally rotated about an axis as it contacts the grinding wheel or lap to form a curved surface of the desired radius. During each operation, the tool is typically removed from the grinding or lapping machine and inspected for microscopic irregularities in the surface finish.

One of the problems encountered in the preparation and inspection of such tools for ultra-precise machining is the difficulty in maintaining a constant radius on the tool surface being ground or lapped. This difficulty arises, in part, from the necessity of repeatedly removing the tool from the grinding or lapping machine for inspection of the cutting edge. Conventional tool holding fixtures are simply inadequately designed to ensure that the axis of a cutting tool is maintained in a constant location relative to the lap during repeated removal for inspection of the tool cutting edge.

A need therefore exists to provide a tool holding fixture which allows an operator to transfer the tool from a lapping or grinding machine to an inspection device while maintaining a precise fixed position of the tool radius relative to the grinding or lapping wheel.

SUMMARY OF THE INVENTION

In view of the above need it is an object of this invention to provide a removably mounted tool holding fixture for maintaining precise tool edge alignment of a radiused edge cutting tool during preparation and inspection of said tool.

Further, it is an object of this invention to provide a tool holding fixture as set forth in the above object wherein the tool is held to oscillate about a precise center axis of the selected tool edge radius by means of a bearing provided by a pair of precisely formed balls fixedly attached to each other and adapted to hold said tool at the selected radius by removably seating said balls in a corresponding pair of precisely aligned bearing seats.

Other objects and many of the attendant advantages of the present invention will be obvious to those skilled in the art from the following detailed description taken in conjunction with the drawings.

DETAILED DESCRIPTION

Figure 1:
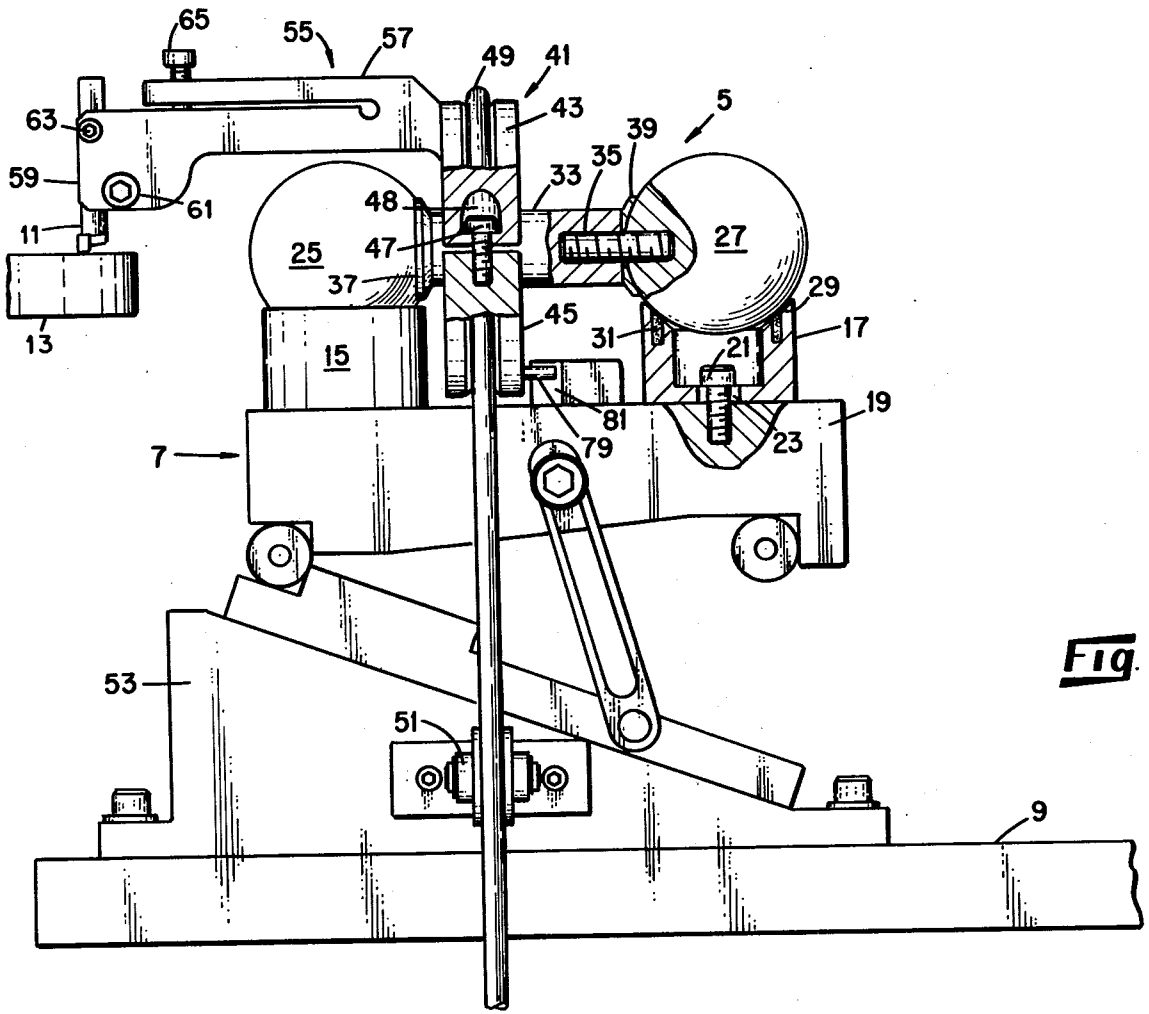
FIG. 1 is a partially cut-away, elevational view of a removably mounted tool holding fixture for preparing and inspecting a radiused edge cutting tool according to the present invention.

Referring now to FIG. 1, the tool holding fixture 5 is shown mounted on a conventional sine plate mounting arrangement 7 attached to a support base 9. The sine plate mount 7 is a conventional mounting jig which may be used to set the angle of the tool 11 relative to a lapping wheel 13. This allows the operator to adjust the angle for lapping various cylindrical or conical shaped tool surfaces.

The tool holding fixture 5 may be mounted in various other ways, but is illustrated here by way of the sine plate mounting arrangement. The fixture 5 consists of a pair of cylindrical bearing seats 15 and 17 adjustably secured to a base member 19, which in this arrangement is the top block of the sine plate 7. The bearing seats are identical and mount 17 is shown in section for illustration. The bearing seats are adjustably secured to the block 19 by means of a set screw 21 extending through a slot 23 in the bottom of the cylindrical cup bearing seat and threaded into the block 19. The upper ends of the seats 15 and 17 are machined to receive bearings 25 and 27, respectively, in a readily removable seating arrangement. The seat is formed on a narrow beveled rim 29 adjacent the outer diameter of the bearing cup. The rim 29 is beveled at an angle to allow the ball to seat on the middle of the outer rim 29 in a minimal contact seating arrangement. A channel 31 may be provided with a felt material which contains a light oil for lubricating the ball surface during operation.

Typically the bearings are commercially available 2 inch diameter stainless steel balls machined to an accuracy of $\pm 25$ microinches or less. The spherical accuracy of the balls generally dictates the accuracy of the tool holding fixture. The bearings 25 and 27 are rigidly tied together by means of a shaft 33. Each ball (25 and 27) is drilled and tapped to threadably receive a stud 35 which also threads into central end drilled and tapped holes in the shaft 33. Centering cups 37 and 39 are provided at the ends of the shaft 33 which contact the balls 25 and 27, respectively, to provide a rigid assembly which rotates, or oscillates, in the bearing seats 15 and 17 through the center line of the balls 25 and 27.

A split pulley arrangement 41 is clamped to the shaft 33. The pulley arrangement includes an upper half portion 43 and a lower half portion 45 which are clamped to the shaft 33 by means of a pair of set screws 47 (only one shown) which fit through openings 48 cut in the pulley valley of the upper half portion 43 and thread into corresponding threaded opening in the lower half portion 45. A belt 49 is provided which slips onto the pulley 41 to oscillate the assembly in the bearing cups from a reversible drive, as will be explained hereinbelow. The belt 49 extends upward from the drive below the fixture over a guide pulley 51, the fixture pulley assembly 41 and back down over another guide pulley, identical to pulley 51, on the opposite side of the inclined sine plate mount 53.

To complete the fixture arrangement, a tool holder assembly 55 is provided as an integral part of the upper pulley half 43. The tool holder assembly 55 includes a forward extending arm 57 which extends over the ball 25 and terminates in a tool holding cradle portion 59 in which the tool 11 is clamped in a selected alignment with the lap wheel 13 by means of adjustable set screws 61 through 65.

Figure 2:
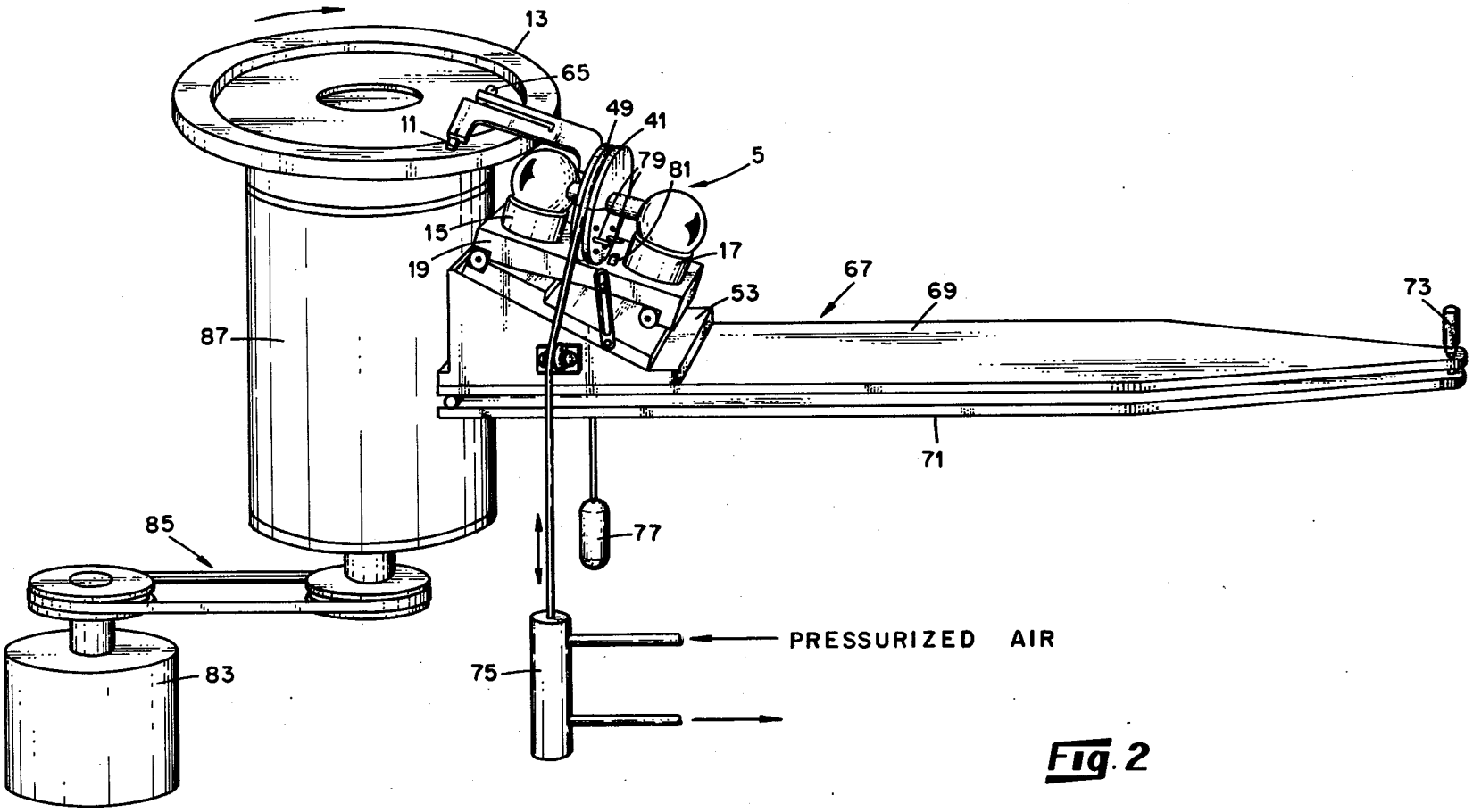
FIG. 2 is a pictorial view of the tool holding fixture of FIG. 1 shown employed in a tool edge lapping apparatus.

Referring now to FIG. 2, the removable tool holding fixture 5 and the mounting hardware shown in FIG. 1 are shown in a typical tool lapping assembly. The inclined mounting base 53 is mounted on another conventional sine plate 67 which is designed for fine adjustments of the tool 11 angle with respect to the lap wheel 13 by means of the long pivot arm plates 69 and 71 of the sine plate 67. A micrometer adjustment 73 is provided at the extended ends of the plates 69 and 71 to aid an operator in making the adjustments. The lower plate 71 is fixed in a level horizontal position as by mounting on a work table (not shown).

The tool holder may be driven by a reversible air piston cylinder arrangement 75 which has the piston connected to the belt 49 which extends over the pulley 41 and terminates at the opposite end in a counterweight 77. The travel of the piston is adjusted in a conventional manner to slowly oscillate the tool 11 over the radiused edge contacting the lap wheel 13. To prevent slipping of the belt or roll over of the tool holder during installation or removal from the bearing cups 15 and 17, a pair of pins 79 are located in a corresponding selected pair of openings provided in the lower half of the pulley 41. A stop 81 is mounted on the base 19 in a position to intercept the pins 79, preventing rotation of the holder past these limits. Thus the holder 5 is prevented from contacting the lap 13 which would damage the precision machined lap surface.

To remove the tool holder 5 from the bearing seats 15 and 17, the operator turns off the air supply to the drive means 75 and pulls upward on the belt 49 slipping it back over the fixture 5. With the belt out of the way the fixture is simply lifted from the bearing cups 15 and 17. Since the bearing cups are fixably attached to the base 19, the axis of rotation, or radius of the tool 11 edge, with respect to the lap 13 is retained without realignment when the holder 5 is replaced in the bearing cups 15 and 17. For example, if, after inspection of the tool cutting surface, it is desired to further finish the tool, it is a simple operation to return the tool fixture to the lapping arrangement, reposition the belt 49 over the pulley 41 and turn the drive means 75 back on to continue lapping without the time consuming realigning required in a conventional lapping machine tool holder.

In the lapping arrangement in which the tool holder 5 is depicted in FIG. 2, the lap wheel, or disc 13, is driven by means of an electric motor 83 through a belt drive arrangement 85 connected between the motor 83 and an air bearing spindle assembly 87. The spindle assembly may be arranged to allow precise vertical adjustment of the lapping wheel 13 to initially set the tool 11 radius. The tool angle is set primarily by use of the sine plate 7. Micro adjustments of the angle may be made with the micrometer 73. The micrometer screw 65 and the micrometer 73 may be used together to facilitate micro vertical adjustments of the tool.

Although the invention has been illustrated by means of a specific embodiment, it will be obvious to those skilled in the art that various modifications and changes may be made in the illustrated embodiment without departing from the scope of the claims attached to and forming a part of this specification. For example, to improve the accuracy, the bearing seats 15 and 17 may be replaced by air bearing seats when ultraprecise motions are desired without limiting the flexibility of the tool holding fixture.

What is claimed is:

1. A displaceable tool holding fixture, for holding a radiused edge cutting tool in a tool edge preparing apparatus, comprising:

a pair of precision formed steel balls;

a shaft rigidly connected between said pair of balls;

a pair of rigid cylindrical bearing seats each having a rim portion of the upper edge thereof beveled to receive respective ones of said pair of balls in a minimal contact seating arrangement, said bearing seats mounted on a support means of said preparing apparatus and aligned to displaceably receive said balls so that said balls are free to rotate in said seats about an axis extending through the center of both balls;

a tool holding means attached to and extending from said shaft for selectively holding said radiused edge tool aligned so that said axis of rotation of said balls is aligned with the axis about which said tool edge is generated when contacting a rotating preparing device; and means for oscillatory rotation of the tool holding fixture through a selected arc sector coincident with the radiused edge sector of said tool.

2. The tool holding fixture as set forth in claim 1 wherein said means for oscillatory rotation of said tool holding fixture includes a pulley mounted coaxially with said shaft, a drive belt having a counterweight connected to one end thereof and removably engaging said pulley, and a reversible drive means connected to said belt at the opposite end thereof for imparting said oscillating rotation to said fixture.

3. The tool holding fixture as set forth in claim 2 further including means for blocking the rotation of said fixture past the angular extent of said selected arc sector.

4. The tool holding fixture as set forth in claim 3 wherein said tool is a shank type tool and said tool holding means includes an arm portion rigidly connected at one end to the upper portion of said pulley and extending in a forward direction over and beyond a forward one of said balls and adapted at the opposite end to receive said tool shank perpendicular to said axis of rotation of said fixture and holding said tool at the selected position of alignment with said axis of rotation of said fixture.

* * * * *